US006066800A

United States Patent [19]

Renaud

[11] Patent Number: 6,066,800

[45] **Date of Patent: *May 23, 2000**

[54] PROCESS FOR THE PRODUCTION OF A SHIELDING SHEATH ON A BUNDLE OF ELECTRICAL CONDUCTORS

[75] Inventor: Thierry Jean-Pierre Renaud, La Fare les Oliviers, France

[73] Assignee: Societe Anonyme Dite: Eurocopter France, Marseille-Provence, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/926,500

[22] Filed: Sep. 10, 1997

Related U.S. Application Data

[62] Division of application No. 08/571,792, Dec. 13, 1995, Pat. No. 5,718,041.

[30] Foreign Application Priority Data

Dec. 13, 1994 [FR] France ..... 94 14969

[51] Int. Cl.[7] ..... H01B 7/34

[52] U.S. Cl. ..... 174/36; 174/72 R

[58] Field of Search ..... 174/36, 72 A, 174/103, 106 R, 71 R, 72 R, 35 R

[56] References Cited

U.S. PATENT DOCUMENTS

| | | | |
|---|---|---|---|
| 2,396,283 | 3/1946 | Papst | 29/828 |
| 3,576,939 | 5/1971 | Zeimek | 174/36 X |
| 4,236,779 | 12/1980 | Tang | 174/103 X |
| 4,640,980 | 2/1987 | Batt et al. | 174/36 |
| 4,822,956 | 4/1989 | Sepe | 29/828 |
| 4,920,235 | 4/1990 | Yamaguchi | 174/36 |
| 5,091,604 | 2/1992 | Kirma | 174/72 A X |
| 5,306,870 | 4/1994 | Abat | 174/71 R X |
| 5,347,090 | 9/1994 | Cerda | 174/84 R |
| 5,378,853 | 1/1995 | Clouet et al. | 174/36 |
| 5,394,502 | 2/1995 | Caron | 174/72 R X |
| 5,414,211 | 5/1995 | Chan | 174/36 |
| 5,535,788 | 7/1996 | Mori et al. | 140/92.1 |

FOREIGN PATENT DOCUMENTS

| | | | |
|---|---|---|---|
| 0554158 A1 | 8/1993 | European Pat. Off. . | |
| 0554159 A1 | 8/1993 | European Pat. Off. . | |
| 888215 | 12/1981 | U.S.S.R. | 29/828 |

*Primary Examiner*—Kristine Kincaid
*Assistant Examiner*—Chau N. Nguyen
*Attorney, Agent, or Firm*—Stevens, Davis, Miller & Mosher, L.L.P.

[57] ABSTRACT

A metal electromagnetic shielding sheath is provided on a multibranched bundle of electrical conductors. The sheath includes sheath elements braided directly on the branches of the bundle, and at least one of the ends of the sheath elements is held captive between two superposed rings gripping the corresponding branch of the bundle.

6 Claims, 6 Drawing Sheets

FIG. 6
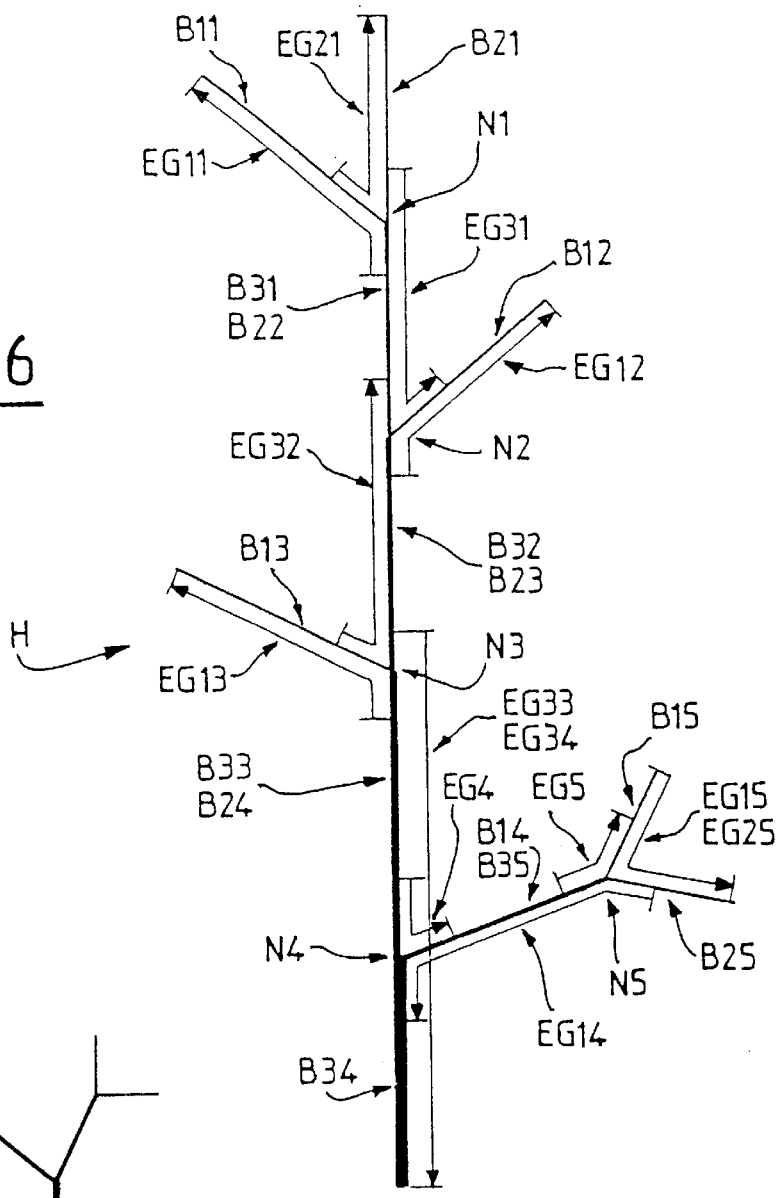
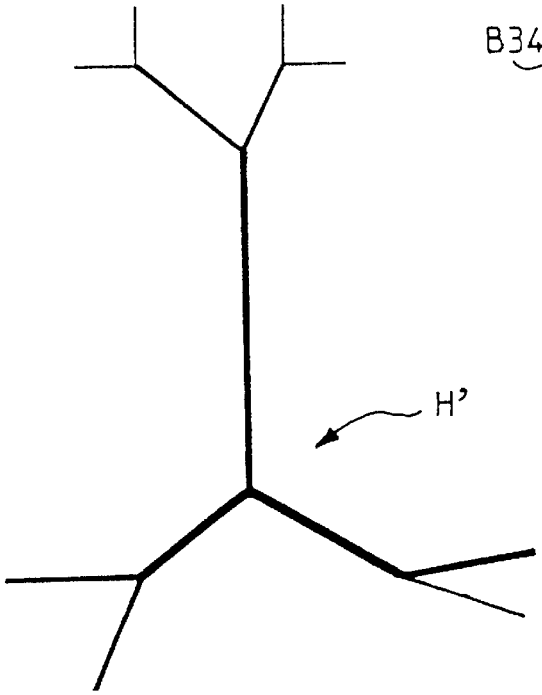
FIG. 7

PROCESS FOR THE PRODUCTION OF A SHIELDING SHEATH ON A BUNDLE OF ELECTRICAL CONDUCTORS

This is a division of application Ser. No. 08/571,792 filed Dec. 13, 1995 now U.S. Pat. No. 5,718,041.

FIELD OF THE INVENTION

The present invention relates to electrical conductor bundles, especially those called harnesses, which are hardened, that is to say shielded against electromagnetic disturbances, and which are intended to electrically connect together the various items of equipment of a complex electrical installation, the correct operation of which must be ensured, even in the event of electromagnetic disturbances. Such harnesses are, for example, used on board aircraft, ships, battle-tanks, etc. The present invention relates to a process for the production of such a shielded bundle or harness, as well as to the bundle obtained by implementing said process.

DESCRIPTION OF RELATED ART

It is known that these harnesses consist of a bundle of conductors which may or may not be stranded and are divided up into several sub-bundles or branches starting from branching nodes arranged along said bundle, and of connectors arranged on the free ends of said branches.

In order to shield them against electromagnetic disturbances, said harnesses are coated with braided metal sheath elements completely covering said conductors. In a known manner, such metal sheath elements may be produced beforehand in the form of braid portions, then slipped over said harness branches and finally electrically connected to one another by sleeves, for example heat-shrinkable sleeves, at said branching nodes, so as to provide mechanical and electrical continuity of said metal sheath. As a variant, also known, each metal sheath element may be braided directly on each of said branches of the harness and include an extension onto another branch serving to provide electrical continuity of the sheath. For this purpose, it is also possible to provide overbraiding at the branching nodes.

The first of the known methods mentioned above leads to the production of shielding sheaths whose electromagnetic performance is relatively poor and whose mechanical strength, especially vibration resistance, is not good enough (which, moreover, further reduces the electromagnetic performance).

On the other hand, the second method (braiding directly on the branches of the bundle) enables excellent electromagnetic and mechanical strength performance to be achieved. However, it often happens that, at the beginning and/or end of the braiding, the ends of the metal strands making up the braided sheath element stand up at right angles to the branch carrying said element, so that the insulation of the subjacent electrical conductors and/or objects which may come into contact with said element are punctured and/or damaged by said stood-up ends. In addition, in order for the braided sheath elements to provide sufficient protection, this second method often requires each of said branches to carry two such elements, which increases the weight and the cost.

SUMMARY OF THE INVENTION

The object of the present invention is to remedy these drawbacks by preventing the ends of the braiding strands from standing up and by providing a better compromise between cost, weight and electromagnetic performance.

To this end, according to the invention, the process for the production of a metal electromagnetic shielding sheath on a multibranched bundle of electrical conductors, in which method sheath elements are braided directly on the branches of said bundle using metal strands, which sheath elements surround said conductors of the branches and are electrically connected to one another in order to form said metal sheath, is noteworthy in that:

- a first ring is arranged at the place provided for one end of a sheath element on a branch, said first ring surrounding said branch;
- next, the braiding of said sheath element is carried out in such a way that said end rests on said first ring; and
- said end of said sheath element is covered by a second ring gripping said first ring.

Thus, said rings prevent the ends of the metal braiding strands from standing up inward and/or outward and prevent objects in contact with them from being harmed. In addition, they make it possible, as will appear in the description hereinbelow, to achieve excellent electromagnetic protection with a single braiding ply on the branches of the bundle.

Advantageously, said rings are made of an electrically conductive material and are pliant and adhesive.

Preferably, the adhesive of said rings is also electrically conductive.

By way of example, these rings may be portions of a thin metal tape, for example one made of copper.

By virtue of these particular features, said rings contribute greatly to the cohesion of the bundle and its shielding sheath, as well as to the electrical and mechanical continuity between the various sheath elements.

In a known manner, the electrical conductor bundles generally include nodes each joining three branches of said bundle. In this case, at each of said nodes, three sheath elements are formed, each of them leading from one of the three branches to one of the other two, the other of said other two branches passing laterally through it, at least one end of said elements being held captive between said first and second rings, and wherein the pair of branches each carrying said three sheath elements is different from the pairs of branches carrying the other two sheath elements.

In the particular case where these three branches have different cross sections, advantageously the initial step is to produce a first sheath element carried by the two branches having respectively the smallest and the largest cross section, then a second sheath element carried by these two branches having respectively the intermediate cross section and the smallest cross section and finally a third sheath element carried by the two branches having respectively the intermediate cross section and the largest cross section.

In addition, said first, second and third sheath elements may cover, respectively, all of said branch having the smallest cross section, all of said branch having the intermediate cross section and all of said branch having the largest cross section and, partially, in the vicinity of said node, said branch having the largest cross section, said branch having the smallest cross section and said branch having the intermediate cross section.

On the other hand, when two or three branches have cross sections which are at least approximately equal, it may be advantageous for one of said sheath elements to cover, continuously, all of said two branches.

Especially in this case, it is particularly advantageous for one of said sheath elements to start on a branch, in the vicinity of said node and to terminate on another branch, also in the vicinity of said node.

When, in a known manner, an electrical connector is mounted on the free end of a branch of the bundle carrying a metal sheath element, it is advantageous to produce a free braiding tail on that end of said sheath element adjacent to said connector, to fold back said braiding tail against the end of said sheath element which surrounds, on the outside, the end-piece of said connector through which said branch enters said connector, and to fix said folded-back braiding tail and said end of said sheath element to said end-piece by clamping.

Thus, this end of the sheath element is solidly fixed to the connector, thereby enabling the latter to be manipulated (connected and disconnected) without initiating the unbraiding of said end.

In the particular case where the electrical conductor bundle is in the form of a harness having a progressively narrowing main trunk with nodes from which said branches branch off, said sheath elements are preferably produced starting with the thinnest branches and ending with the thickest branches.

However, in order to benefit from an already existing adjustment of the braider producing said sheath elements and thus to decrease the total braiding time, when close but not necessarily consecutive branches have approximately equal cross sections, the braiding of the corresponding sheath elements is carried out consecutively.

Moreover, the present invention also relates to a multi-branched electrical conductor bundle coated with a metal electromagnetic shielding sheath formed by sheath elements braided directly on the branches of said bundle using metal strands. According to the invention, at least one of the ends of said sheath elements is held captive between two superposed rings gripping the corresponding branch of said bundle.

When electrical connectors are provided on the ends of said branches opposite said node, said bundle is noteworthy on one side of a connector, the corresponding sheath element includes a free braiding tail which is folded back against the sheath portion surrounding the end-piece of said connector through which the corresponding branch penetrates the connector and which is clamped against said end-piece.

BRIEF DESCRIPTION OF THE DRAWINGS

The figures of the appended drawing will make it clearer how the invention may be realized. In these figures, identical references designate similar elements.

FIG. 6 illustrates a possible implementation of the present invention for shielding a conductor harness by producing protective sheath elements in accordance with the present invention.

FIG. 7 shows another example of a harness capable of being shielded in accordance with the invention.

DETAILED DESCRIPTION OF THE PREFERRED EMBODIMENTS

Figure 1:
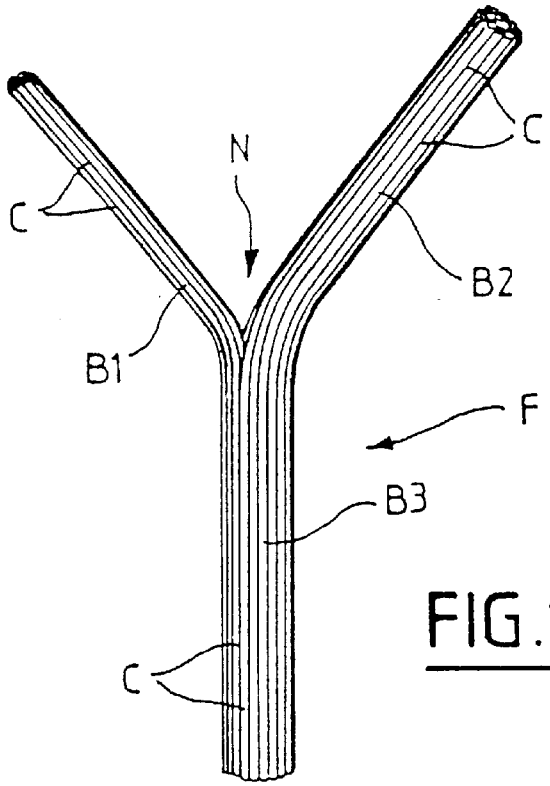
FIG. 1 shows a portion of an electrical conductor bundle, in the vicinity of a node connecting three branches.

FIG. 1 shows a portion of a bundle F of electrical conductors C, which may or may not be stranded, in the vicinity of a node N connecting three branches B1, B2 and B3 of said bundle F.

Figure 2:
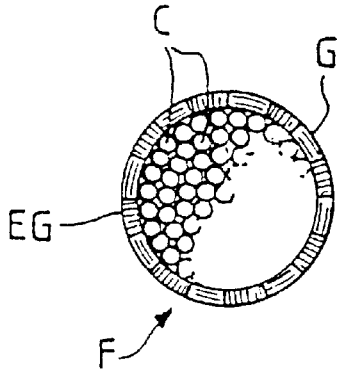
FIG. 2 shows, in cross section and on a larger scale than FIG. 1, an electrical conductor bundle provided with a metal electromagnetic shielding sheath.

In the usual manner, as has been shown in cross section in FIG. 2, in order to harden said bundle F, each branch of the latter is surrounded with a braided metal sheath G element EG protecting the corresponding conductors C from external electromagnetic disturbances. As has been mentioned hereinabove, each sheath element EG is preferably produced by direct braiding of the corresponding branch of the bundle F, for example by means of a braider.

As will be apparent from the following explanations, especially with regard to FIGS. 3A to 3J, the sheath elements EG in accordance with the present invention are produced branch by branch, partially covering another branch, so as to ensure that all the nodes N are covered satisfactorily.

One possible embodiment of the braided sheath elements EG on the bundle F, at a node N, will be described with the aid of FIGS. 3A to 3J. In the example of the bundle F in FIG. 3A, it has been assumed that the portion of bundle F has branches B1, B2, B3 of unequal cross sections, the branch B1 having the smallest cross section and the branch B3 the largest.

Figure 3A:
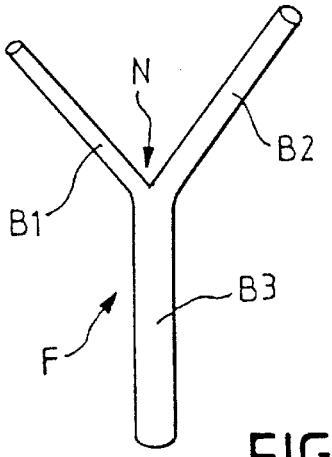
FIGS. 3A to 3J diagrammatically illustrate various steps in one possible implementation of the process for producing braided sheath elements at the node in FIG. 1, in accordance with the present invention.
Figure 3B:
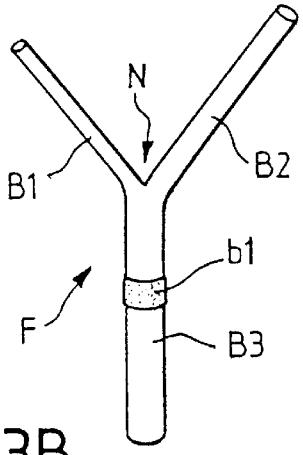
Figure 3C:
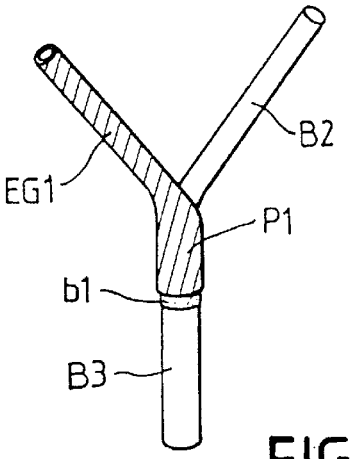

As illustrated in FIG. 3B, the initial step in this example is to place a first ring b1, gripping the largest cross section branch B3 in the vicinity of the node N, at the place provided for the starting end of a sheath element EG1 (see below). This first ring b1 may consist of a portion of electrically conductive metal tape, for example made of copper.

Preferably, this conductive tape is adhesive, having an adhesive which may or may not be conductive, so as to be able to adhere to the branch B3 easily, following the periphery of the latter perfectly. The tape must ensure that possible stood-up ends of the sheath element EG1 cannot harm the conductors C of the bundle F.

Next (FIG. 3C), the bundle F is placed in the braider and then the sheath element EG1 is then produced, starting approximately from the middle of the first ring b1 and bearing toward the node N, which sheath element EG1 includes a part P1 covering the branch B3 in the vicinity of the node N and completely covers the branch B1. This sheath element EG1 is produced so that the branch B2 passes laterally through it, where it joins the node N. The braiding parameters (the number of strands braided, the number of reels delivering said strands and the braiding pitch) are adjusted so that said sheath element EG1 and its part P1 cover, without any gaps and without overlapping, respectively all of the branch B1 and part of the branch B3. Since it is assumed that the branch B1 has a smaller cross section than the branch B3, it may be seen that it is necessary for the braiding pitch on the branch B3 (part P1) to be smaller than on the branch B1.

Figure 3D:
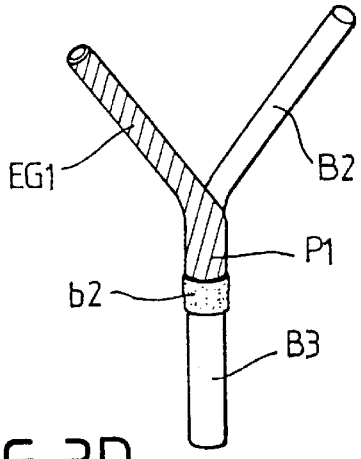

As shown in FIG. 3D, the start of the sheath element EG1 is secured on the first ring b1 by a second ring b2 which grips the corresponding end of said sheath element EG1 and which is placed on top of the first ring b1. The second ring b2 may be produced in a similar way to the first ring b1 and it ensures that the ends of the metal strands, forming said sheath element EG1, cannot stand up toward the outside. Thus, said ends are held captive between said first and second rings.

Next (FIG. 3E), a third ring b3 (similar to the previous ones) is placed so as to grip the sheath element. EG1 on the branch B1 in the vicinity of the node N, at the place provided for the starting end of a sheath element EG2, (see below). The ring b3 must ensure that the braiding strands of this sheath element EG2 cannot damage the sheath element EG1 and/or the subjacent conductors C.

In a manner similar to that described hereinabove with regard to the sheath element EG1, the braiding of the bundle F element (see FIG. 3F) is continued by producing, starting from approximately the middle of the third ring b3 and going toward the node N, the sheath element EG2, which includes a part P2 covering the sheath element EG1 (that is to say the branch B1) in the vicinity of said node N and which completely covers the branch B2. The branch B3, partially covered by the braiding part P1, passes laterally through the sheath element EG2, where it joins the node N. Of course, because of the cross section ratios given by way of hypothesis, the braiding pitch of the element EG2 is greater on the branch B1 than on the branch B2.

Figure 3E:
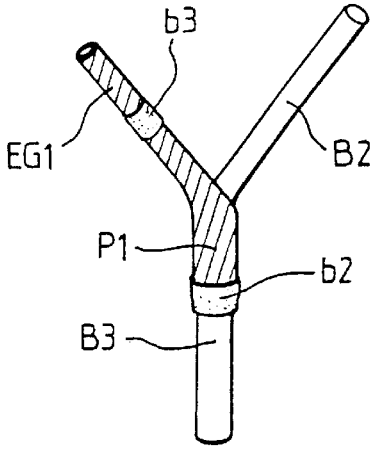
Figure 3F:
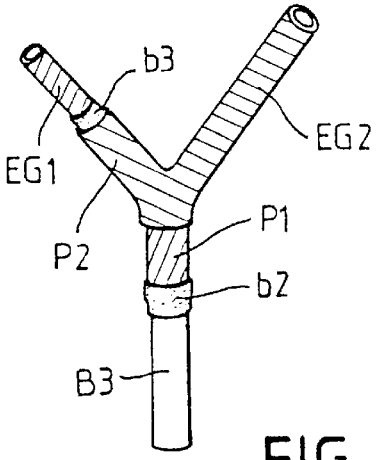
Figure 3G:
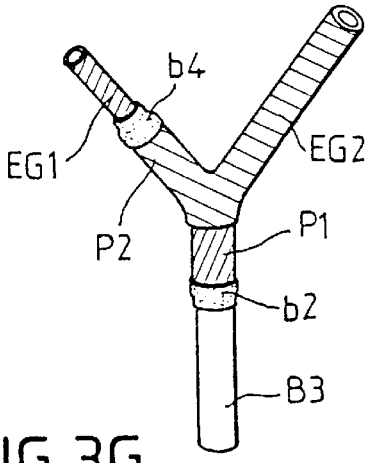

As shown in FIG. 3G, the starting end of the sheath element EG2 is secured on the third ring b3 by a fourth ring b4 which grips the corresponding end of said sheath element EG2 and which is placed on top of the third ring b3. The fourth ring b4 may be produced in a similar way to the three previous rings b1, b2 and b3 and it ensures that the ends of the metal strands, forming the sheath element EG2, cannot stand up, these ends being held captive between said third and fourth rings b3 and b4.

Figure 3H:
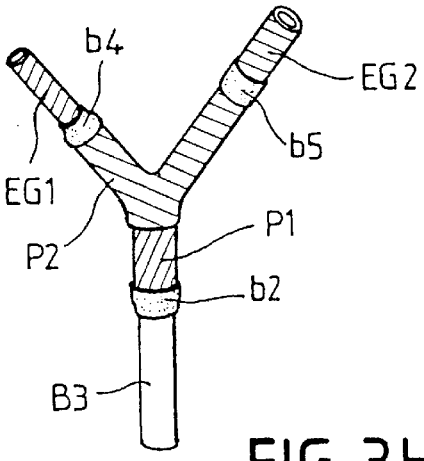
Figure 3I:
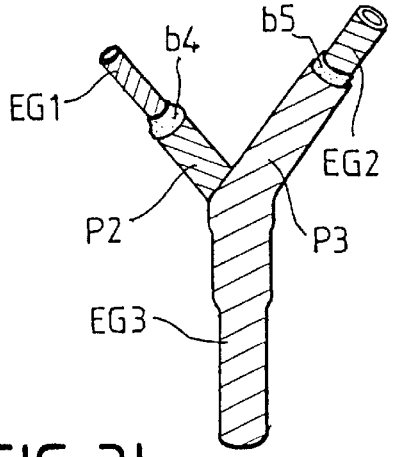

Next, as shown in FIG. 3H, a fifth ring b5 (similar to the previous ones) is placed so as to grip the sheath element EG2 on the branch B2 in the vicinity of the node N, at the place provided for the starting end of a sheath element EG3 (see below). The ring b5 must ensure that the braiding strands of this sheath element EG3 cannot damage the sheath element EG2 and/or the subjacent conductors C.

In a similar manner to that described herein-above, the sheath element EG3 is then produced (see FIG. 31), starting from approximately the middle of the fifth ring b5 and working toward the node N, which sheath element EG3 includes a part P3 covering the sheath element EG2 (branch B2) in the vicinity of said node and completely covers the branch B3. The branch B1, covered by the sheath element EG1 and by the braiding part P2, passes laterally through the sheath element EG3, where it joins the node N. The braiding pitch on the branch B2 is greater than on the branch B3. The sheath element EG3 covers the first and second rings b1 and b2 of the sheath element EG1 and holds them in position.

Figure 3J:
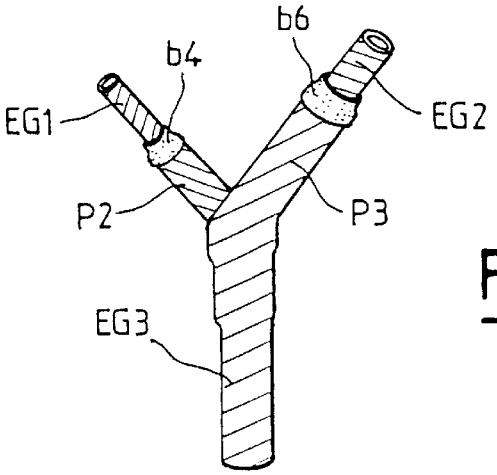

Next, as shown in FIG. 3J, the starting end of the sheath element EG3 is secured on the fifth ring b5 by a sixth ring b6 which grips the corresponding end of said sheath element EG3 and which is placed on top of the fifth ring b5. The sixth ring b6 may be produced in a similar manner to the five previous rings b1 to b5 and it ensures that the ends of the metal strands, forming the sheath element EG3, cannot stand up, these ends being held captive between said fifth and sixth rings b5 and b6.

The embodiment of the invention illustrated by FIGS. 3A to 3J is only one example of braiding, from among others, which takes into account the cross section differences of the branches B1, B2 and B3. However, it is immediately obvious that it is possible, for example for reasons of convenience and topology, to reverse the directions of braiding, that is to say to begin the braiding of the sheath elements EG1, EG2 and EG3, respectively at the ends of the branches B1, B2 and B3, opposite the node N, and to finish it respectively on the rings b1, b3 and b5.

The embodiment described with regard to FIGS. 3A to 3J and the embodiment with a reversed braiding direction, mentioned hereinabove, are particularly advantageous since they ensure that there is a good seating of the sheath element EG1 on the branches B1 and B3, and then of the sheath element EG2 on the branch B2 and on the sheath element EG1. The sheath element EG2 is thus prevented from slipping while the bundle is being handled during braiding. Likewise, the sheath element EG3 adheres strongly to the bundle F, because it is held by the sheath elements EG2 and EG1 (part P1).

Thus, even if the angle between the branches B1 and B2 is very acute (closed), there is no risk of slippage of the sheath elements EG1, EG2 and EG3.

From the foregoing, it will easily be understood that the use of rings b1 to b6 in the form of an adhesive conductive tape having a conductive adhesive, is advantageous since such rings improve the electrical continuity and contribute to the mutual cohesion of the sheath elements EG1, EG2 and EG3.

Figure 4A:
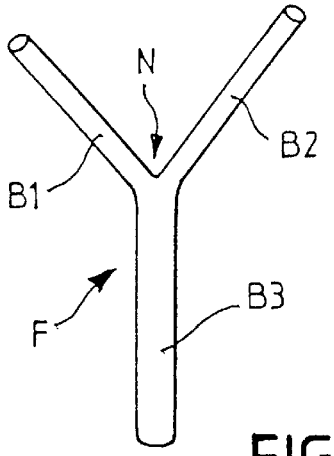
FIGS. 4A to 4H illustrate an alternative embodiment of the braided sheath elements.
Figure 4B:
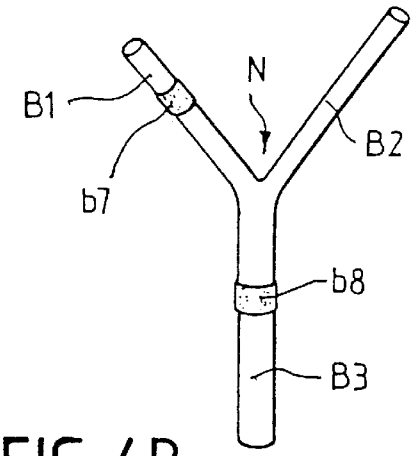
Figure 4C:
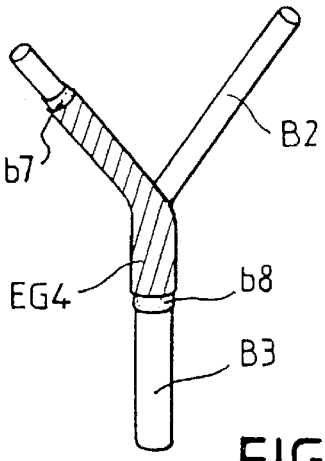
Figure 4D:
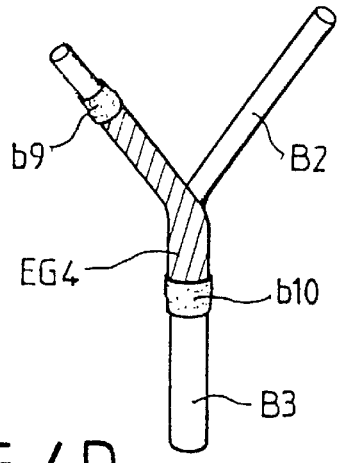
Figure 4E:
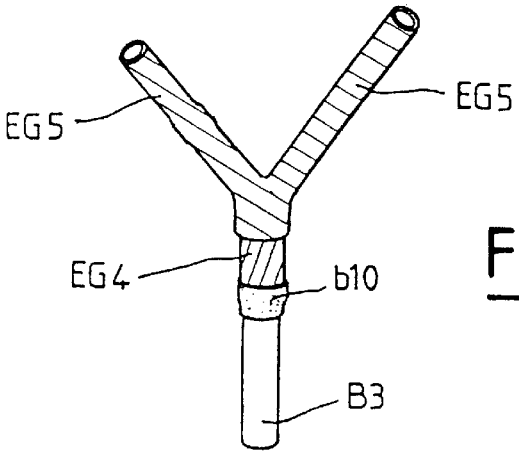
Figure 4F:
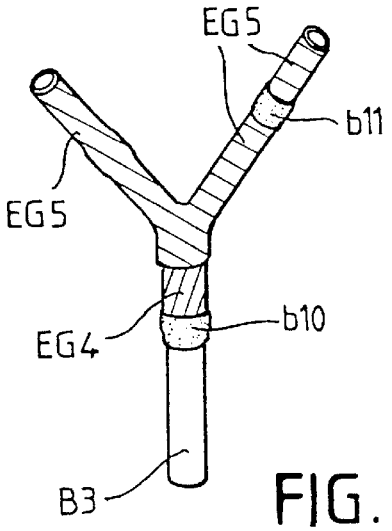
Figure 4G:
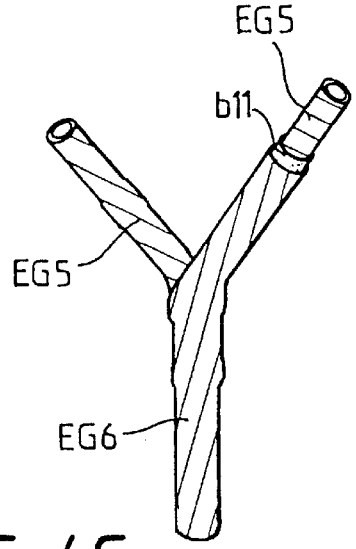
Figure 4H:
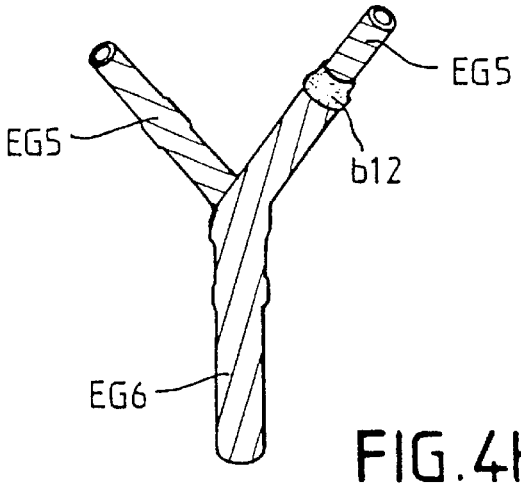

FIGS. 4A to 4H show an alternative embodiment of the sheath elements forming the braided sheath G, said alternative embodiment being most particularly appropriate to being employed when the branches B1 and B2 have identical cross sections (see FIG. 4A). According to this alternative embodiment:

- a ring b7 is arranged on the branch B1 in the vicinity of the node N (see FIG. 4B) and likewise a ring b8 is arranged on the branch B3. These rings b7 and b8 are comparable to the ring b1 in FIG. 3B;
- then, the sheath element EG4 partially covering the branch B1 and the branch B3 is braided, said sheath element EG4 starting astride the ring b7 and finishing astride the ring b8 (see FIG. 4C);
- the ends of the sheath element EG4 are covered by rings b9 and b10, respectively placed on top of the rings b7 and b8 (see FIG. 4D);
- a sheath element EG5 is braided, which covers, continuously and completely, the branches B1 and B2 (see FIG. 4E);
- a ring b11, comparable to the ring b3 in FIG. 3E, is arranged on the sheath element EG5 on the branch B2 and in the vicinity of the node N (see FIG. 4F);
- a sheath element EG6 is braided, starting astride said ring b11 and partially covering the branch B2 and completely covering the branch B3 (see FIG. 4G); and
- the starting end of the sheath element EG6 is covered by a ring b12 placed on top of the ring b11.

Figure 5:
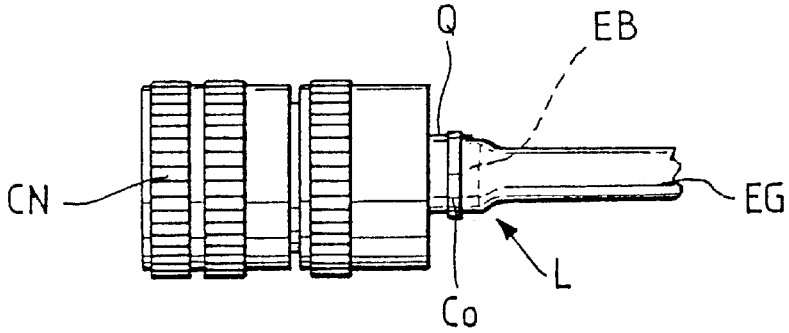
FIG. 5 illustrates the fixing of a sheath element in the vicinity of a connector.

FIG. 5 shows the end L of a braided metal sheath element EG (which may be any one of the elements EG1, EG2, EG3, EG5 or EG6), opposite the node N, and it has been assumed that this end L had been connected by being fitted, on the outside, onto the end-piece EB of a connector CN. That branch of the bundle F which carries the sheath element EG enters the connector CN through said end-piece EB. In this case, it is advantageous to provide, on the external part of the end L, a free braiding tail Q which is folded back against that part of the end L fitted onto the end-piece EB and which is clamped against the latter by a clamping ring Co.

Of course, the braiding of the sheath element may begin with the tail Q and terminate by being held captive between said first and second rings (b1, b2; b3, b4; b5, b6; b11, b12), or else conversely to begin on said rings and terminate in said braiding tail Q. Such a free braiding tail is easy to produce when the bundle F is not in place in the braider.

The harness H, shown in FIG. 6, represents a particular case of a conductor bundle F, in which the conductors C form a main trunk from the nodes of which branches branch off. In the example in FIG. 6, the harness H includes five nodes Ni (i=1, 2, 3, 4 or 5) and the branches starting from or ending at a node Ni bear the references B1*i*, B2*i* and B3*i*, by analogy with the above branches B1, B2 and B3.

Shown in FIG. 6 are arrows symbolizing the direction of braiding of the various sheath elements: the tail end of an arrow marks the start of braiding and the tip of an arrow indicates the braided branch and the point where the braiding ends. The thickness of the lines of the branches of the harness symbolizes the cross sections of the various branches.

The metal sheath is formed on the harness H in FIG. 6 by progressing from the branches of smaller cross sections toward the branches of larger cross sections, implementing the particular features illustrated by FIGS. 3A to 3J or 4A to 4H, depending on the case.

Thus, the initial step is to produce the sheath element EG11 which starts on the branch B31 (which corresponds to the branch B22 of the node N2) and terminates on the terminal branch B11 of smaller cross section. Next, the sheath element EG21 is produced, this starting on the branch B11 and terminating on the branch B21, this having a cross section greater than the branch B11 but less than the branch B31.

If the branch B12 has the same cross section as the branch B21 (that is to say the braiding parameters are the same for said branches B12 and B21), the sheath element EG12 is then produced, covering the branch B12 and starting on the branch B32 (which corresponds to the branch B23 of the node N3). The braiding time and the use of the braider are thus optimized by producing thereafter sheath elements having the same braiding parameters.

Next, the sheath element EG31 is produced by making it start on the branch B21, covering all of the branch B31 (B22) and stopping on the branch B12.

Next, the element EG13 is braided, covering the branch B13 and starting on B33 (B24), since the branches B31 and B13 are assumed to be similar, followed by the braiding of the element EG32 starting from the branch B13, covering the branch B32 (B23) and stopping on the branch B31 (B22).

The two branches B15 and B25 are assumed to have the same cross section. It is then possible to produce a short sheath element EG5 starting from B14 (B35) in the vicinity of the node N5 and stopping on the branch B15, in the vicinity of N5. The branches B15 and B25 of identical cross section are then covered with a single sheath element EG15 (EG25) which starts at the end of the branch B15 and stops at the end of the branch B25.

The branches B33 (B24) and B34 have similar cross sections, which makes it possible to use, on the braider, identical numbers of strands and reels, only the braiding pitch being different. It is then possible to follow the following procedure:

a short sheath element EG4 is produced, this starting from the branch B33 (B24) in the vicinity of the node N4 and stopping on the branch B14 (B35), still in the vicinity of the node N4;

the sheath element EG14 is produced, this starting on the branch B25, covering the branch B14 (B35) and terminating on the branch B34, in the vicinity of the node N4;

finally, the continuous sheath element EG33-EG34 is produced, this starting on the branch B32 (B23) and covering the branches B33 (B24) and B34, passing via the node N4.

FIG. 7 shows a harness H' which includes several branches connecting various items of equipment (not shown) and having variable cross sections, but which does not have a main axis serving the various directions.

From the description which has just been given, it will be understood that the harness H' in FIG. 7 may be coated with a braided protection sheath, just like the harness H in FIG. 6.

Thus it may be seen that, by virtue of the present invention, shielding sheaths may be easily produced for harnesses, benefitting from an excellent compromise between cost, weight and electromagnetic performance. In fact, apart from the branching modes, these sheaths have only one ply of braiding.

We claim:

1. A multibranched electrical conductor bundle coated with a metal electromagnetic shielding sheath formed by sheath elements braided directly on branches of said bundle using metal braiding strands, wherein at least one end of said sheath elements is held captive between (i) an inner ring and (ii) an outer ring concentric with the said inner ring, said inner ring and said outer ring each being made of electrically conductive material, and wherein an inner periphery of said end of the sheath elements is disposed against an outer periphery of the inner ring, and an outer periphery of said end of the sheath elements is disposed against an inner periphery of the outer ring, whereby the metal braiding strands are prevented from standing up.

2. The multibranched electrical conductor bundle as claimed in claim 1, wherein said rings are pliant and adhesive.

3. The multibranched electrical conductor bundle as claimed in claim 2, wherein the adhesive of said rings is electrically conductive.

4. The multibranched electrical conductor bundle as claimed in claim 1, wherein said rings are portions of a thin metal tape.

5. The multibranched electrical conductor bundle as claimed in claim 4, wherein said thin metal tape is made of copper.

6. The multibranched electrical conductor bundle as claimed in claim 1, wherein said inner ring and said outer ring each comprises a first annular end and a second annular end, and wherein said end of the sheath elements is disposed at an axial position intermediate between said first annular end and said second annular end of the inner and outer rings.

* * * * *